US010236610B2

(12) United States Patent
Lin et al.

(10) Patent No.: US 10,236,610 B2
(45) Date of Patent: Mar. 19, 2019

(54) GROUNDING BAR CONTACTING SHIELDING PLATE, GROUNDING CONTACT, WIRE BRAIDING AND SHELL

(71) Applicant: FOXCONN INTERCONNECT TECHNOLOGY LIMITED, Grand Cayman (KY)

(72) Inventors: Jun Lin, Kunshan (CN); Hung-Chi Yu, New Taipei (TW); Zhi-Jian Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/838,375

(22) Filed: Dec. 12, 2017

(65) Prior Publication Data

US 2018/0166812 A1 Jun. 14, 2018

(30) Foreign Application Priority Data

Dec. 12, 2016 (CN) ..... 2016 1 1138903

(51) Int. Cl.
*H01R 12/72* (2011.01)
*H01R 12/75* (2011.01)
(Continued)

(52) U.S. Cl.
CPC ..... *H01R 12/75* (2013.01); *H01R 12/721* (2013.01); *H01R 12/72* (2013.01);
(Continued)

(58) Field of Classification Search
CPC ..... H01R 13/6581; H01R 13/6585; H01R 13/6592; H01R 13/6593; H01R 13/65802;
(Continued)

(56) References Cited

U.S. PATENT DOCUMENTS 7,220,146 B2 * 5/2007 Miyazaki ..... H01R 9/0527 439/402
7,878,850 B2 * 2/2011 Wu ..... H01R 13/6581 439/497
(Continued)

FOREIGN PATENT DOCUMENTS

CN 206004086 U 3/2017

*Primary Examiner* — Gary F Paumen
(74) *Attorney, Agent, or Firm* — Wei Te Chung; Ming Chieh Chang

(57) ABSTRACT

An electrical connector includes an insulative housing, a plurality of upper contacts and a plurality of lower contacts disposed in the housing with a metallic shielding plate therebetween, and a metallic shielding shell enclosing the housing. The upper contacts have the signal contacts and the grounding contacts alternatively arranged with each other along a transverse direction. A plurality of wires are located behind the housing. Each of the wires includes an inner conductor mechanically and electrically connected to the corresponding signal contacts, and an outer braiding layer surrounding the inner conductor. A grounding bar is mechanically and electrically connected to all the shielding plate, the braiding layer, the grounding contacts and the shell.

15 Claims, 14 Drawing Sheets

(51) Int. Cl.
*H01R 24/60* (2011.01)
*H01R 107/00* (2006.01)
*H01R 13/6582* (2011.01)
*H01R 13/6593* (2011.01)

(52) U.S. Cl.
CPC ..... *H01R 13/6582* (2013.01); *H01R 13/6593* (2013.01); *H01R 24/60* (2013.01); *H01R 2107/00* (2013.01)

(58) Field of Classification Search
CPC ..... H01R 13/648; H01R 2103/00; H01R 13/658; H01R 23/688; H01R 23/7073; H01R 12/75; H01R 12/721; H01R 12/72; H01R 13/6582; H01R 24/60; H01R 2107/00
USPC ..... 439/579, 95, 607.05
See application file for complete search history.

(56) References Cited

U.S. PATENT DOCUMENTS 8,007,325 B2 * 8/2011 Yotsutani ..... H01R 13/112 439/579
9,455,535 B1 * 9/2016 Chiang ..... H01R 13/6585
9,525,241 B1 * 12/2016 Su ..... H01R 13/6581
9,722,342 B2 * 8/2017 Yuan ..... H01R 13/428
9,929,502 B2 * 3/2018 Zhang ..... H01R 13/6273
2012/0184134 A1 * 7/2012 Zhao ..... H01R 12/592 439/579
2015/0214672 A1 * 7/2015 Wu ..... H01R 12/775 439/579
2016/0043510 A1 * 2/2016 Peng ..... H01R 13/6593 439/607.01
2016/0064864 A1 * 3/2016 Kao ..... H01R 13/6461 439/607.05
2016/0079714 A1 * 3/2016 Wu ..... H01R 13/6585 439/607.05
2016/0118750 A1 * 4/2016 Guo ..... H01R 13/6585 439/78
2016/0149348 A1 * 5/2016 Kao ..... H01R 13/6585 439/607.05
2016/0149349 A1 * 5/2016 Kao ..... H01R 13/6586 439/607.05
2016/0149350 A1 * 5/2016 Kao ..... H01R 12/724 439/607.05
2016/0172791 A1 * 6/2016 Fan ..... H01R 13/6585 439/607.05
2016/0197443 A1 * 7/2016 Zhang ..... H01R 13/6585 439/607.05
2016/0380387 A1 * 12/2016 Wu ..... H01R 13/6581 439/95
2017/0018883 A1 * 1/2017 Chen ..... H01R 24/62
2017/0149161 A1 * 5/2017 Yuan ..... H01R 13/428
2017/0352992 A1 * 12/2017 Lin ..... H01R 12/7005
2018/0054012 A1 * 2/2018 Zhu ..... H01R 4/023

* cited by examiner

GROUNDING BAR CONTACTING SHIELDING PLATE, GROUNDING CONTACT, WIRE BRAIDING AND SHELL

FIELD OF THE DISCLOSURE

The invention is related to an electrical connector, and particularly to the electrical connector with the grounding bar contacting the shell, the grounding contacts and the braiding of the corresponding wires.

DESCRIPTION OF RELATED ARTS

The conventional electrical connector includes an electrical connector with a set of cable linked thereto. The electrical connector includes an insulative housing, a plurality of upper contacts and a plurality of lower contacts with a metallic shielding plate therebetween, and a metallic shielding shell enclosing the housing. A grounding bar is basically connected to the shielding plate, and further connected to the braiding layers of the wires of the cable, and further forwardly connected to the corresponding grounding contacts.

It is desired to provide an electrical connector with the grounding bar easily and reliably soldered to the corresponding wires and grounding contacts, and further electrically connected to the metallic shell of the connector.

SUMMARY OF THE DISCLOSURE

To achieve the above desire, an electrical connector includes an insulative housing, a plurality of upper contacts and a plurality of lower contacts disposed in the housing with a metallic shielding plate therebetween, and a metallic shielding shell enclosing the housing. The upper contacts have the signal contacts and the grounding contacts alternatively arranged with each other along a transverse direction. A plurality of wires are located behind the housing. Each of the wires includes an inner conductor mechanically and electrically connected to the corresponding signal contacts, and an outer braiding layer surrounding the inner conductor. A grounding bar is mechanically and electrically connected to all the shielding plate, the braiding layer, the grounding contacts and the shell.

DETAILED DESCRIPTION OF THE PREFERRED EMBODIMENT

Figure 1:
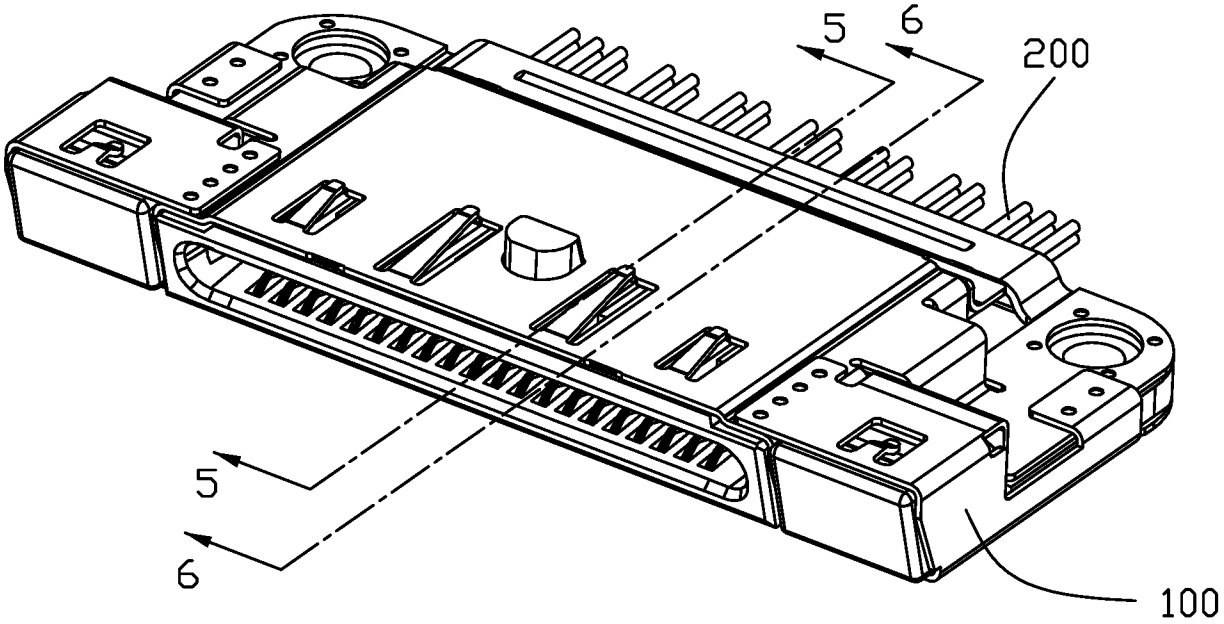
FIG. 1 is a front perspective view of an electrical connector according to the first embodiment of the invention.
Figure 2:
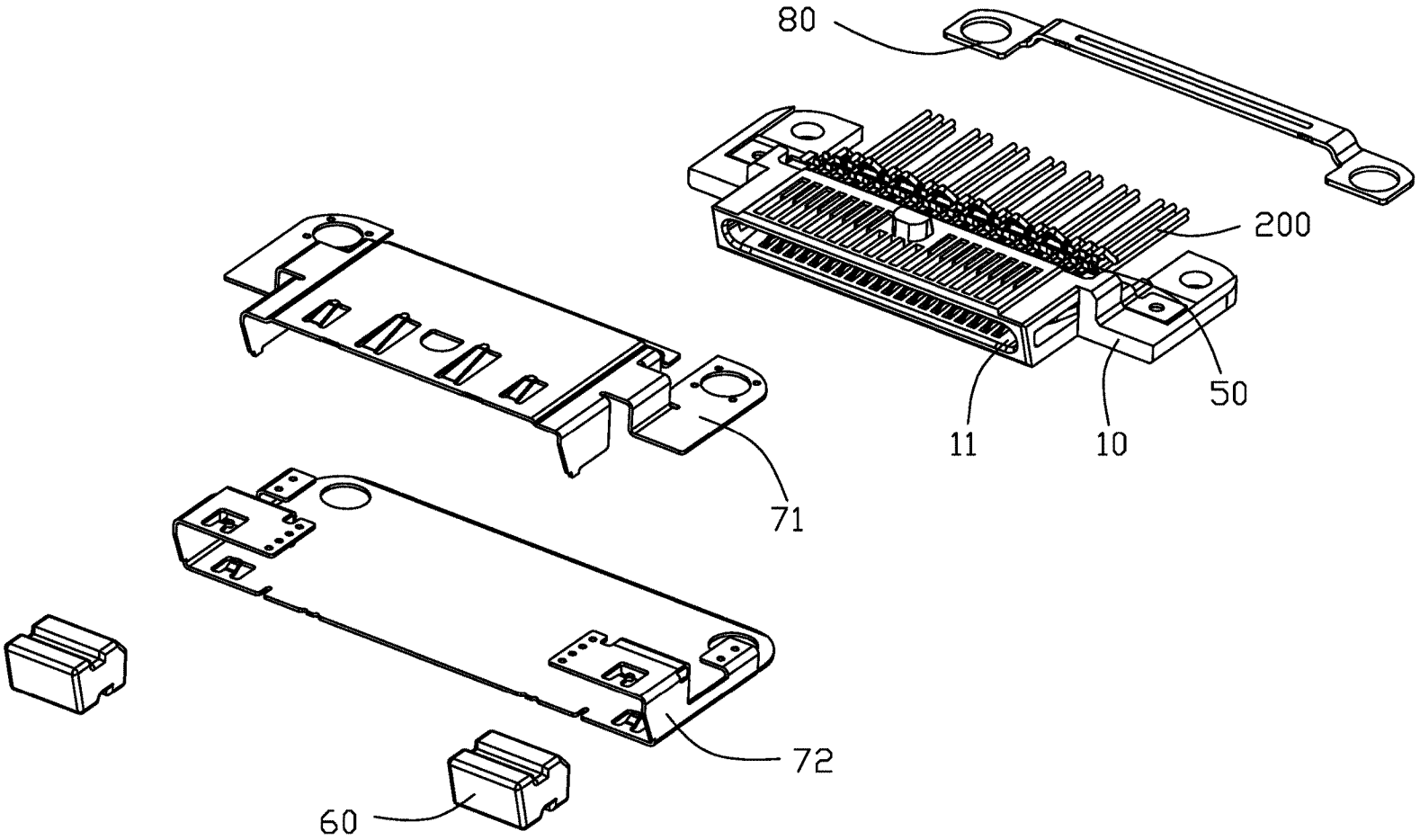
FIG. 2 is a front exploded perspective view of the electrical connector of FIG. 1.
Figure 3A:
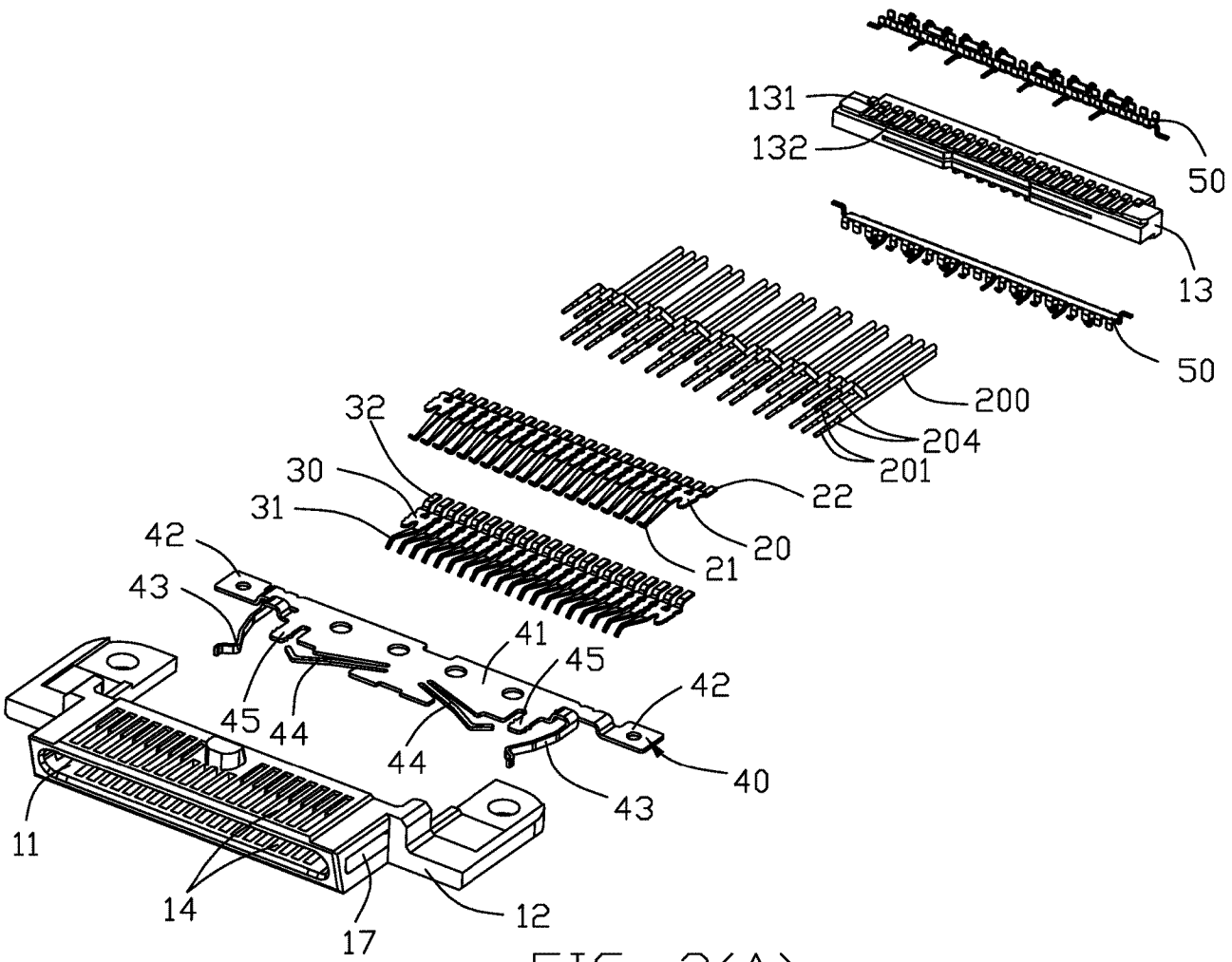
FIG. 3(A) is a front further exploded perspective view of the electrical connector of FIG. 2 without the shielding shell and the magnets.
Figure 3B:
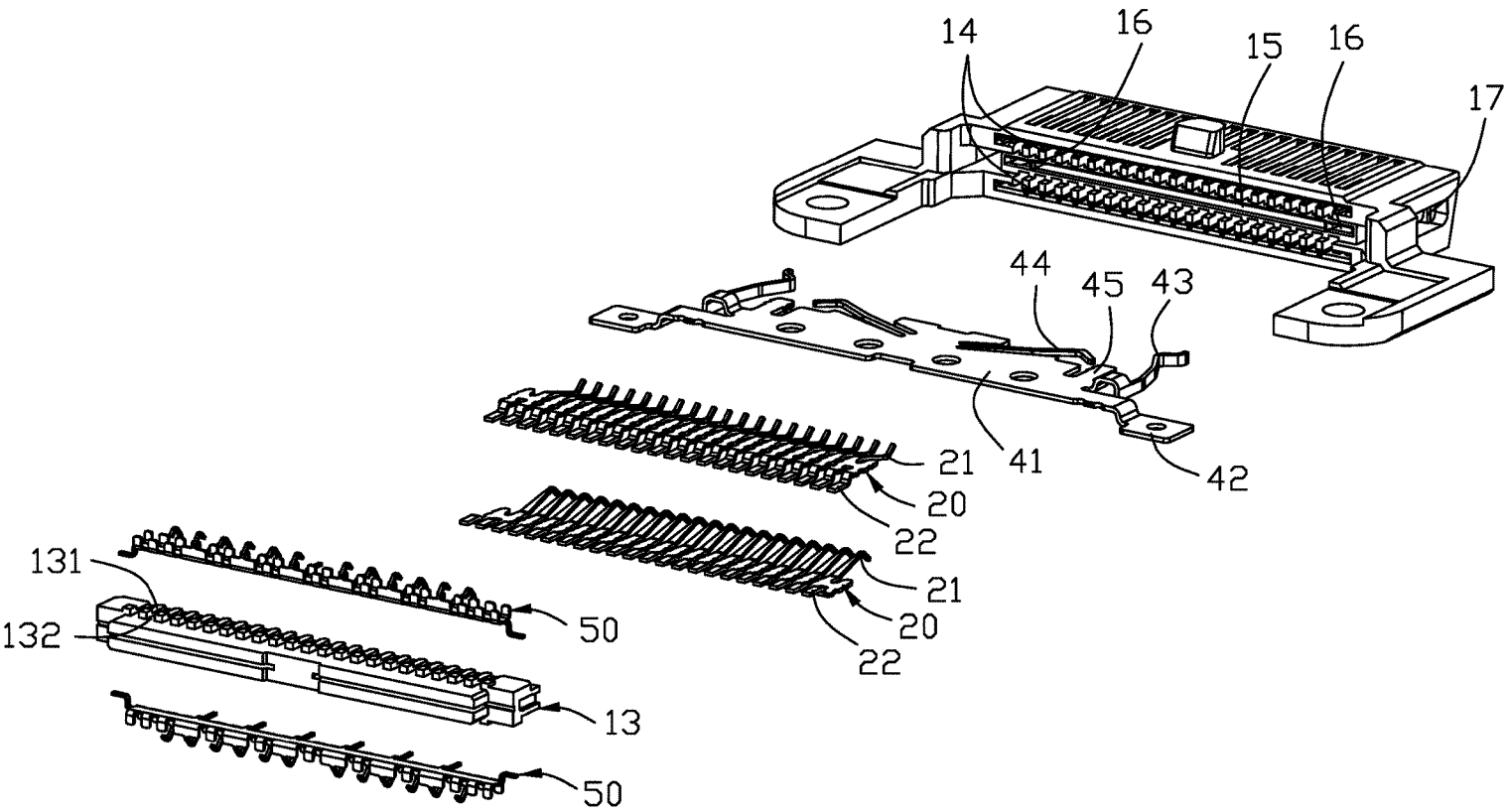
FIG. 3(B) is a rear further exploded perspective view of the electrical connector of FIG. 2 without the shielding shell, the magnets and the wires.
Figure 3C:
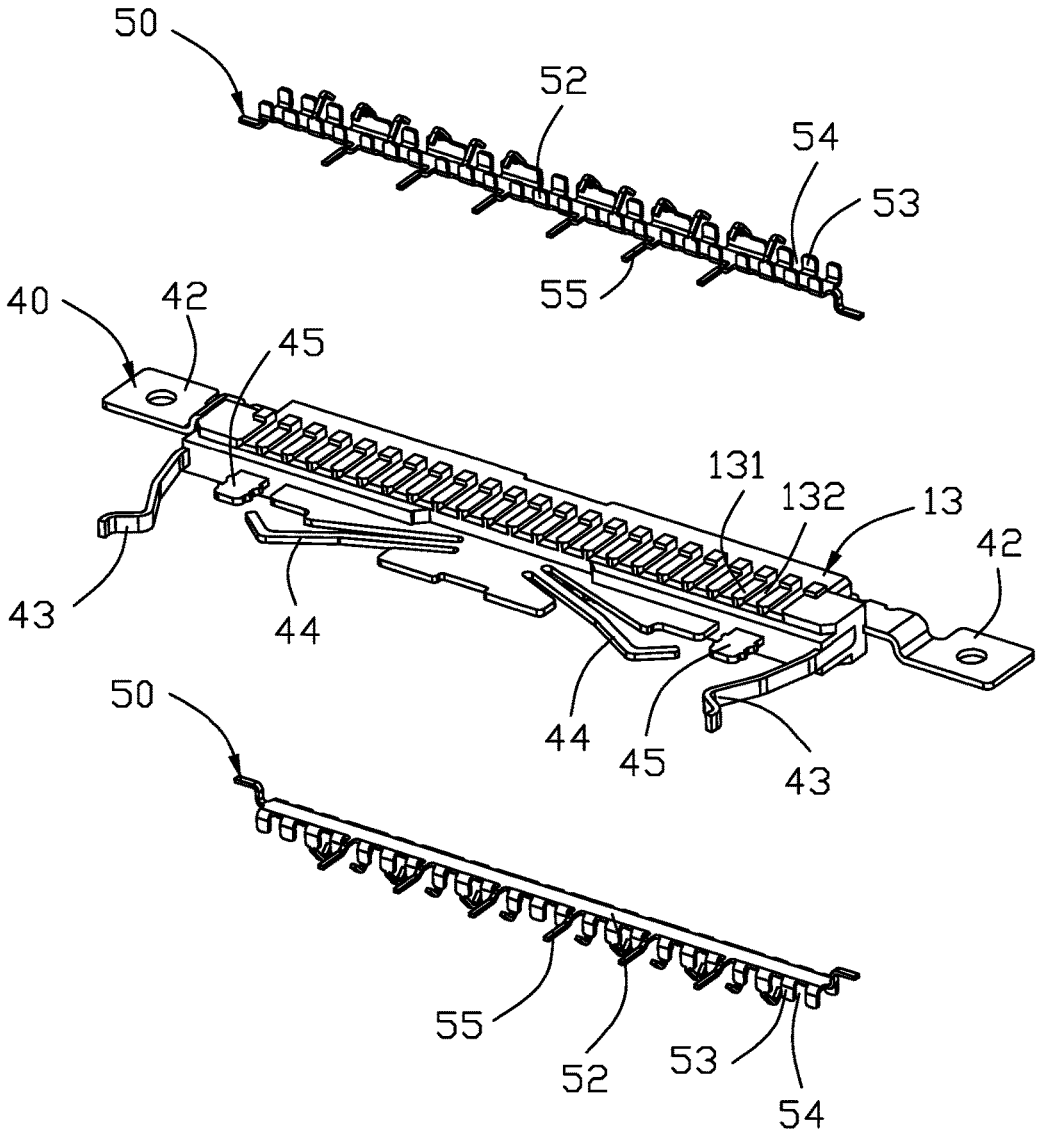
FIG. 3(C) is a front exploded perspective view of the shielding plate with the associated insulator and the pair of grounding bars detached therefrom.
Figure 4A:
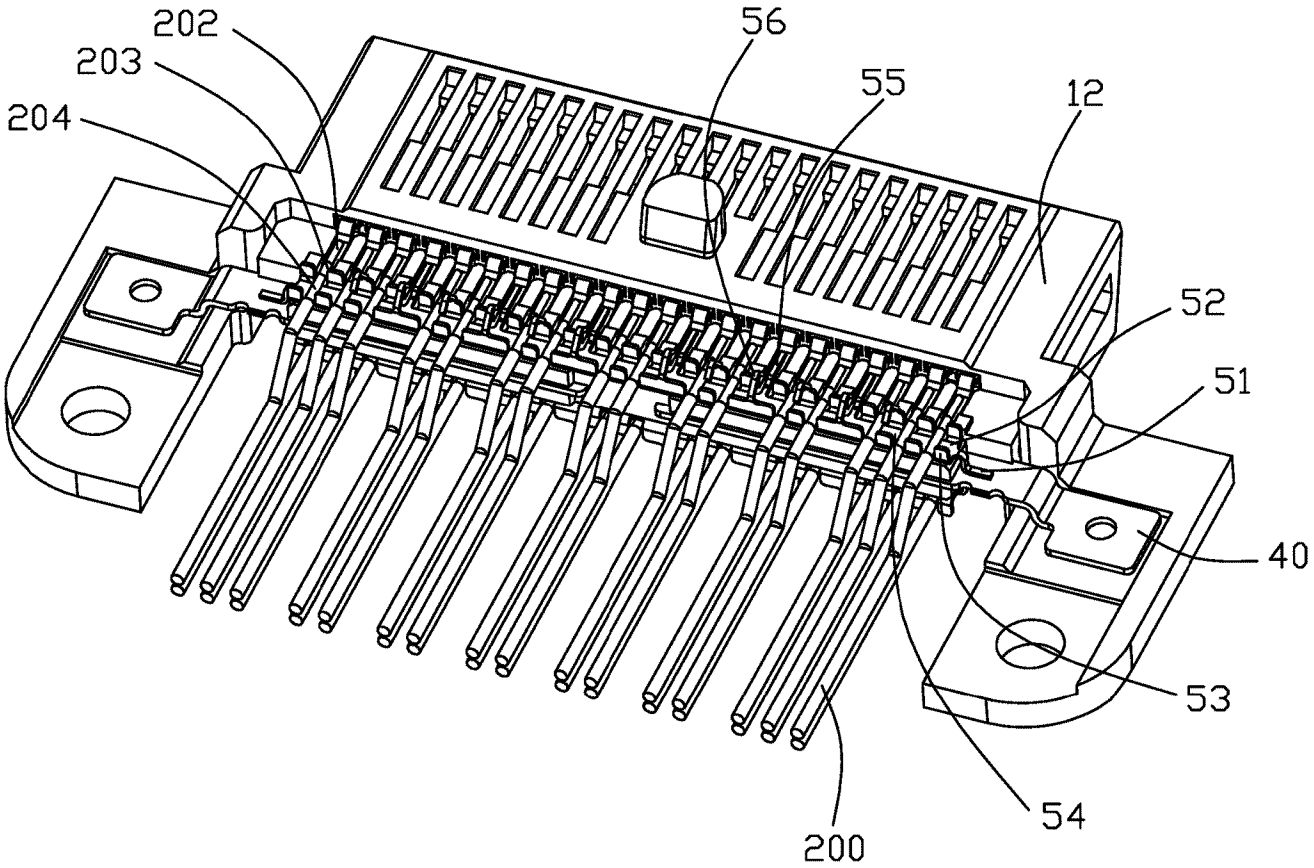
FIG. 4(A) is a rear perspective view of the electrical connector of FIG. 1 by removing the shielding shell and the magnets therefrom.
Figure 4B:
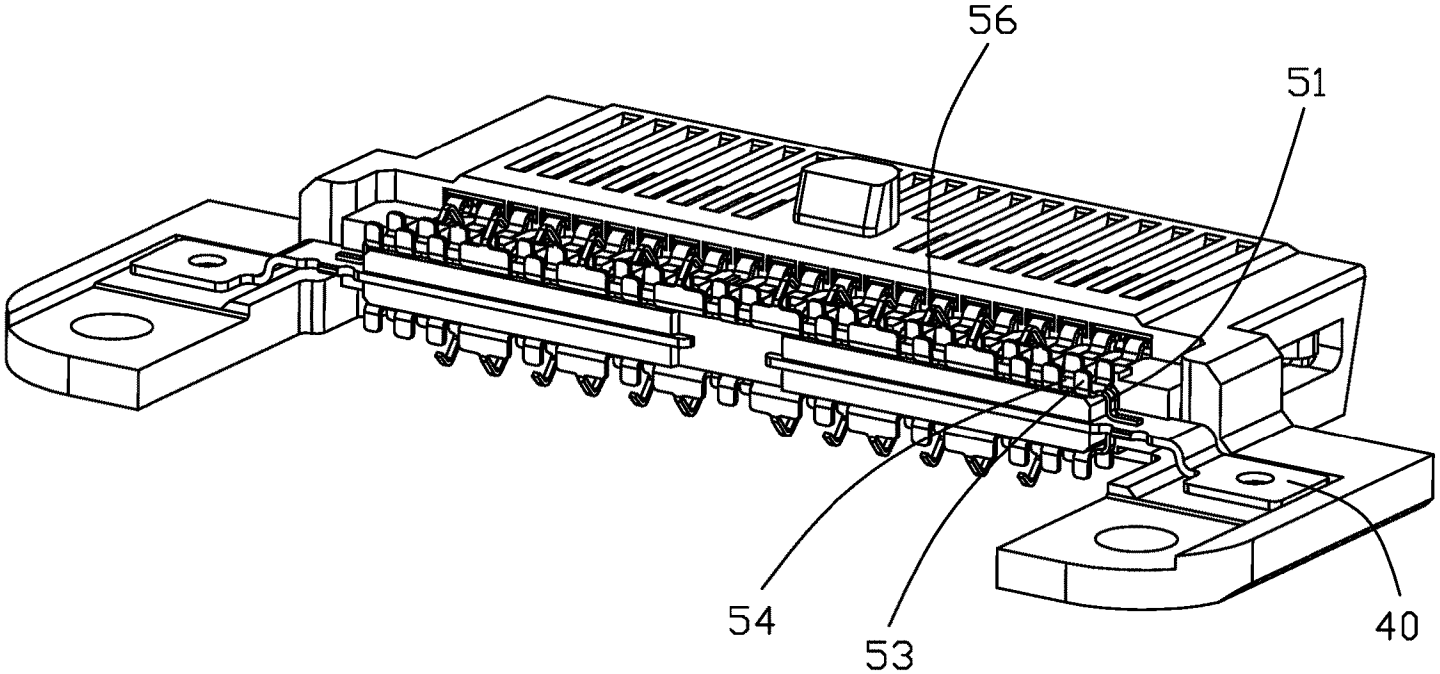
FIG. 4(B) is a rear perspective view of the electrical connector of FIG. 1 by removing the shielding shell, the magnets and the wires therefrom.
Figure 5:
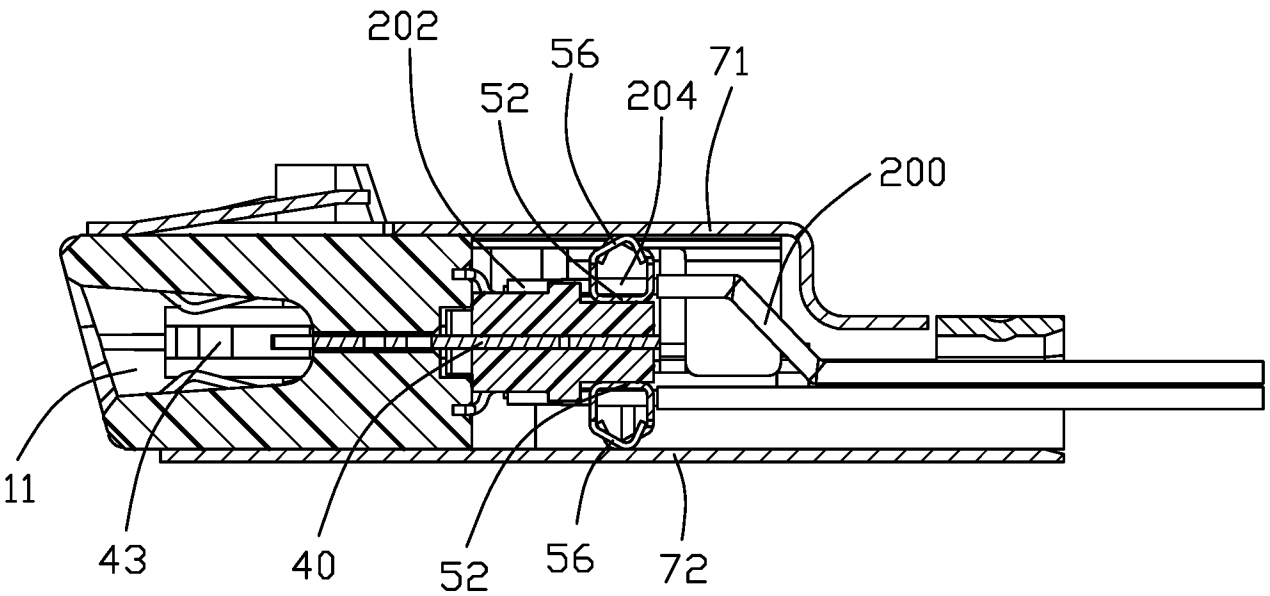
FIG. 5 is a cross-sectional view of the electrical connector of FIG. 1.
Figure 6:
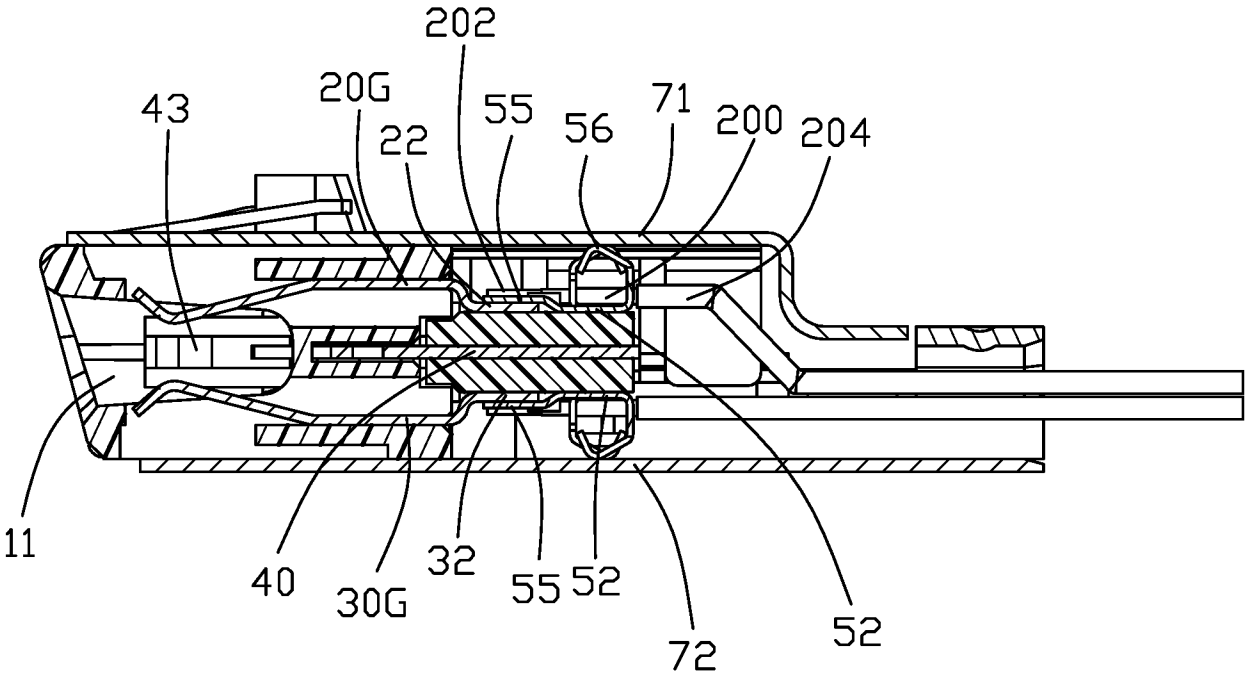
FIG. 6 is another cross-sectional view of the electrical connector of FIG. 1.
Figure 7:
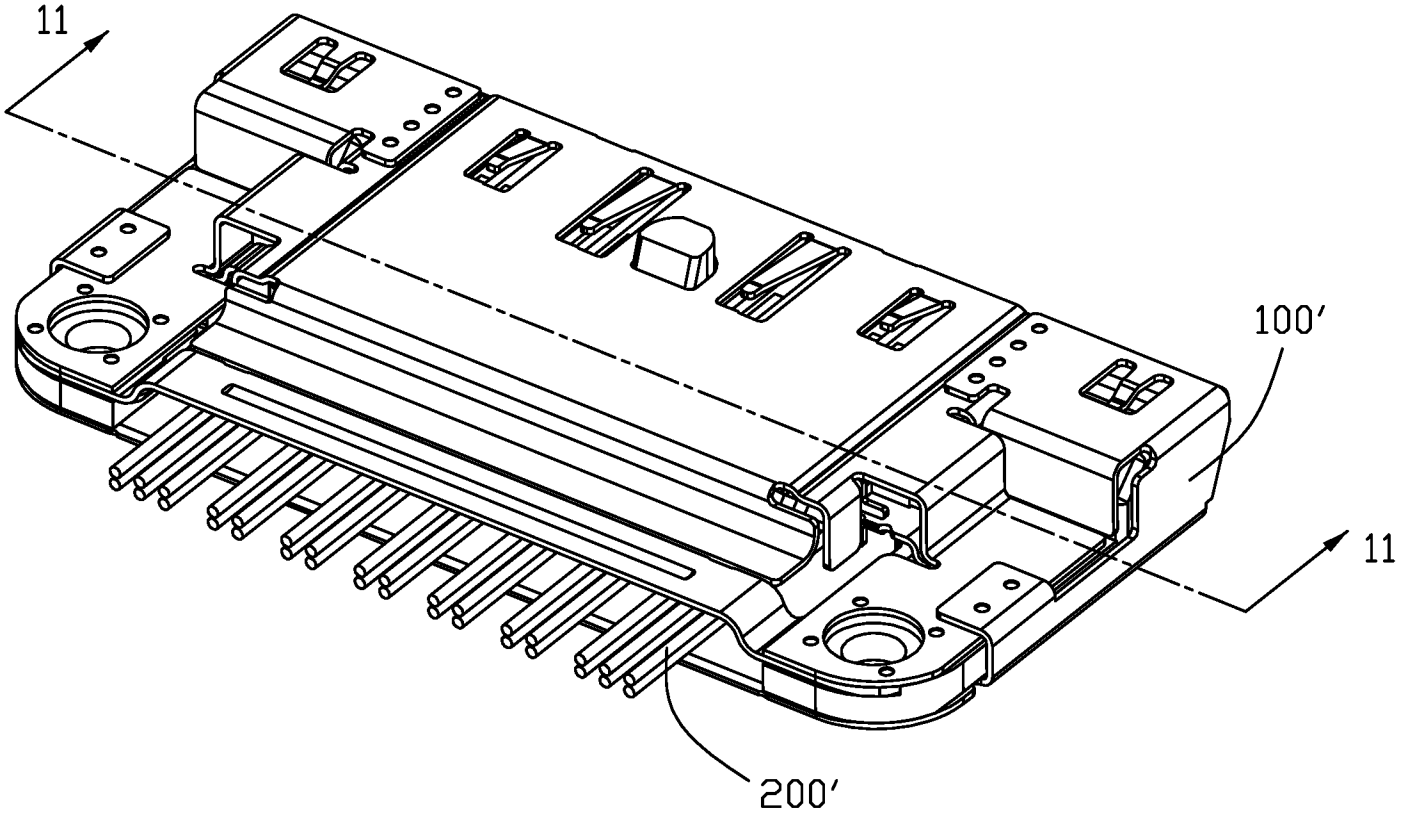
FIG. 7 is a rear perspective view of the electrical connector according to a second embodiment of the invention.
Figure 8:
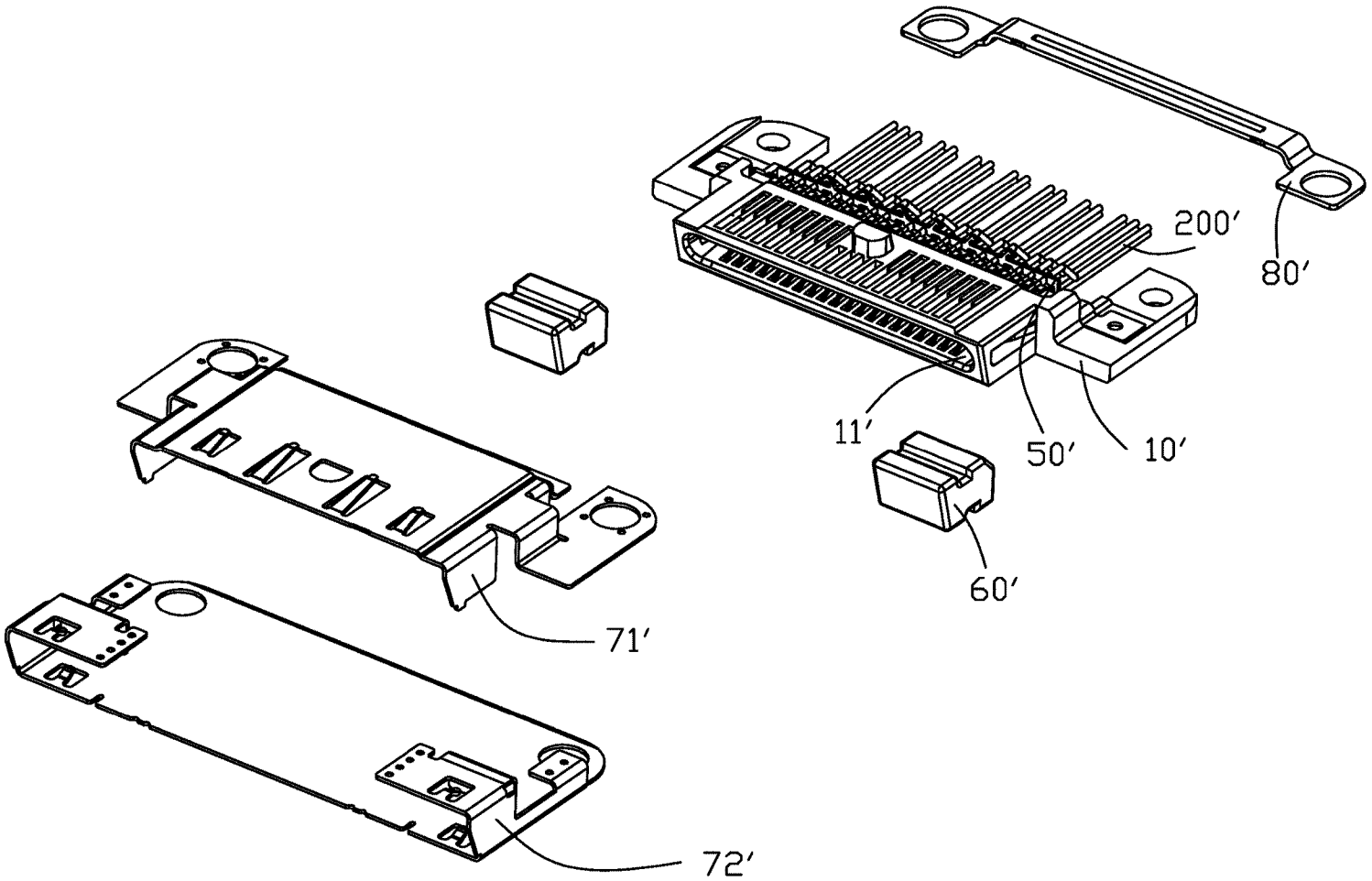
FIG. 8 is a front exploded perspective view of the electrical connector of FIG. 7.
Figure 9:
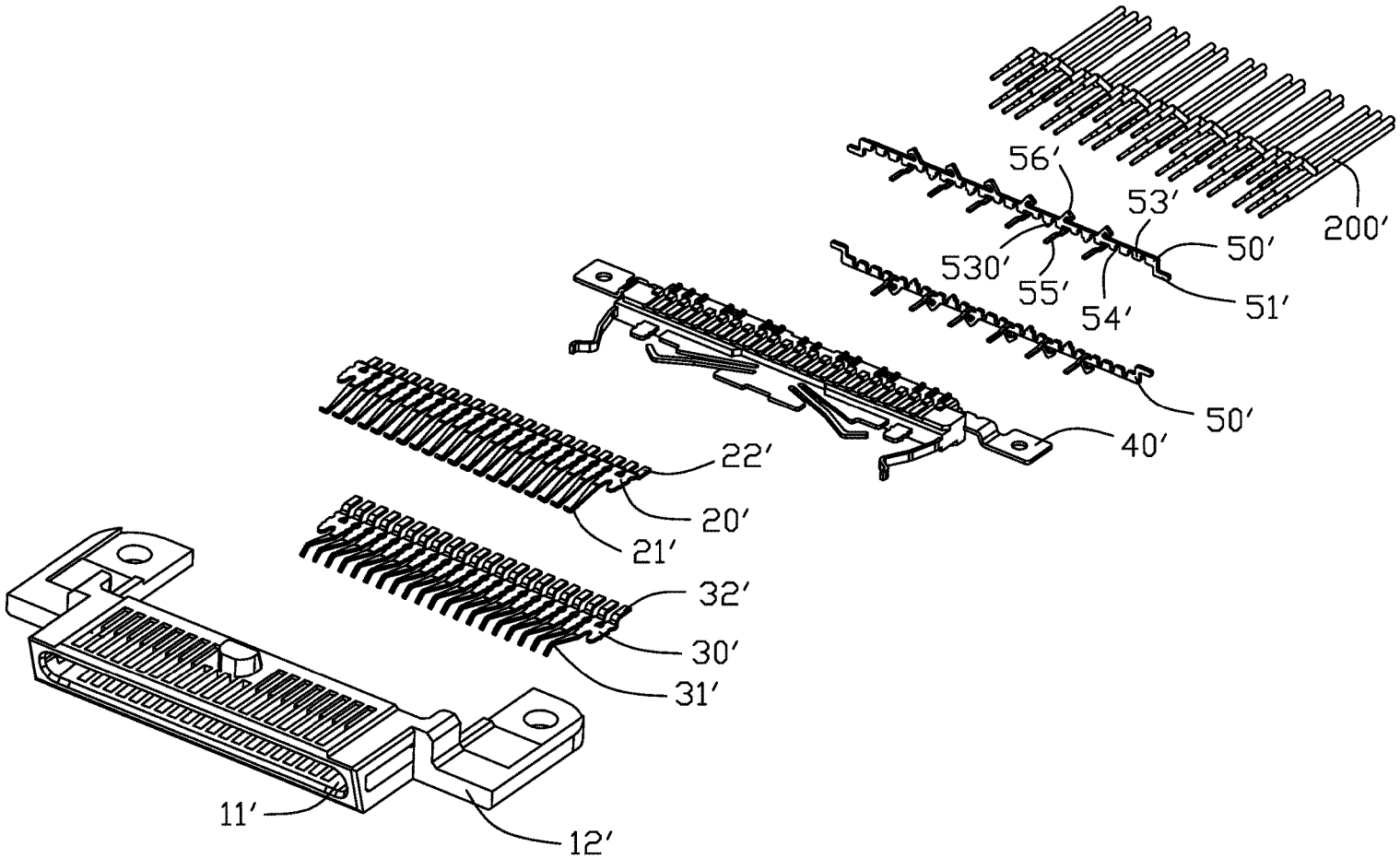
FIG. 9 is a front further exploded perspective view of the electrical connector of FIG. 7.
Figure 10:
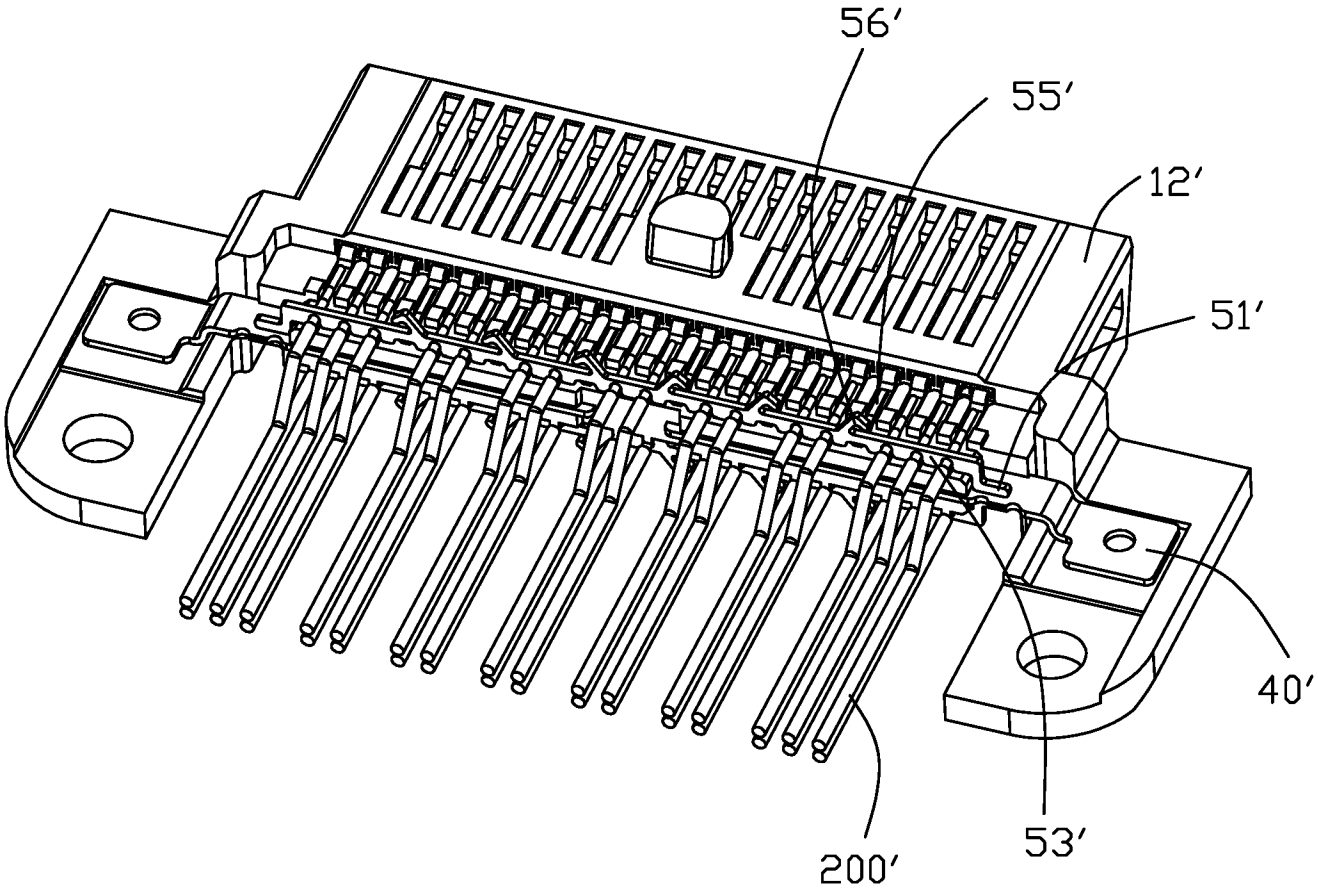
FIG. 10 is a rear perspective view of the electrical connector of FIG. 7 by removing the shielding shell.
Figure 11:
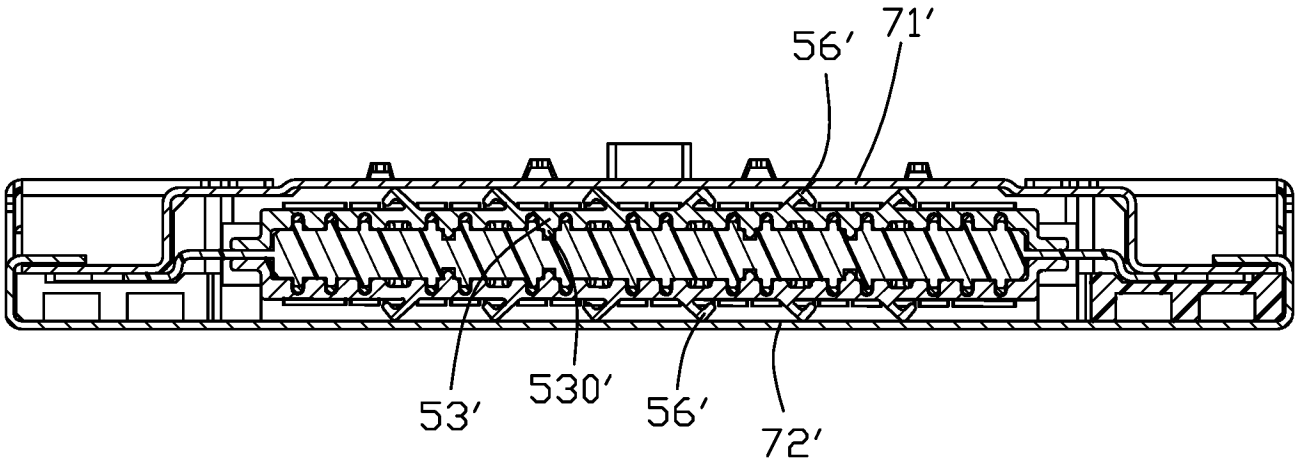
FIG. 11 is a cross-sectional view of the electrical connector of FIG. 7

Reference will now be made in detail to the embodiments of the present disclosure. Referring to FIGS. 1-11, an electrical connector assembly includes an electrical connector 100 and the a plurality of wires 200. The electrical connector 100 includes an insulative housing 10, a plurality of contacts disposed in the housing 10, a metallic shielding plate 40, a pair of grounding bars 50, a pair of magnets 60, and a metallic shielding shell subassembly. The shielding shell subassembly includes an upper shell 71 and the lower shell 72. A pressing piece 8 is assembled upon the housing 10 to hold the wires 200 in position.

The housing 10 includes a front/first insulator 12 and a rear/second insulator 13. The first insulator 12 forms a forwardly opened mating cavity 11, and a plurality of passageways 14 extending along the front-to-back direction and communicating with the mating cavity 11 in the vertical direction perpendicular to the front-to-back direction. The first insulator 12 further includes a pair of slots 17 at two opposite ends, a pair of retention slits 16 and a through slit 15 therebetween in the transverse direction perpendicular to both the front-to-back direction and the vertical direction. The contacts include a plurality of upper contacts 20 and a plurality of lower contacts 30 respectively received within the corresponding passageways 14. The second insulator 13 forms a plurality of ribs 131 with a plurality of grooves 132 each between every adjacent two ribs 131.

The upper contact 20 includes an upper/first contacting section 21 extending into the mating cavity 11 for mating with a terminal of the complementary receptacle connector, and an upper/first soldering section 22 received within the corresponding groove 132 of the second insulator 13 for soldering to an inner conductor 202 of the corresponding wire 200. The lower contact 30 includes a lower/second contacting section 31 extending into the mating cavity 11 for mating with a terminal of the complementary receptacle connector, and a lower/second soldering section 32 received within the corresponding groove 132 for soldering to an inner conductor of the corresponding wire 200.

The shielding plate 40 is assembled within the second insulator 13 via an insert-molding process, and located between the upper contacts 20 and the lower contacts 30. The shielding plate 40 includes a main body 41 retained in the second insulator 13 and extending along a transverse direction, a pair of positioning pads 42 at two opposite ends of the transverse direction to be seated upon the first insulator 12, a pair of spring latches 43 received with the corresponding slots 17 and extending sidewardly into the mating cavity 11, a pair of spring fingers 44 extending forwardly through the slit 15 into the mating cavity 11, and a pair of securing tabs 45 retained in the retention slits 16 for securing the second insulator 13 to the first insulator 12.

The grounding bars 50 are located upon two opposite surfaces of the second insulator 13. Each grounding bar 50 includes an elongated wall 52 with a pair of opposite abutment arms 51, at two opposite ends in the transverse direction, to be soldered/seated upon the shielding plate 40 for electrical connection therebetween. A plurality of protrusions 53 extend from the elongate wall 52 with a plurality of grooves 54 alternately arranged with the protrusions 53 along the transverse direction for retaining the corresponding wires 200 therein, respectively. A plurality of contacting fingers 55 extend from the elongated wall 52 to be received within the corresponding grooves 132 and seated upon the corresponding upper/lower soldering sections 22/32 of the grounding contacts 20G/30G. A plurality of spring tangs 56 extend from the corresponding protrusions 53 for contacting the upper shell 71 and the lower shell 72, respectively. Understandably, each wire has an inner conductor 202 soldered upon the corresponding soldering sections 22/32 of the corresponding contacts 20/30, respectively, and an outer conductor 204 or braiding surrounding the inner conductor 202 with an inner insulator 203 therebetween, soldered or attached to the elongated wall 52.

Referring to FIGS. 7-11, the electrical connector assembly includes an electrical connector 100' and the wires 200'. All reference numerals illustrating the elements of the second embodiment are same with those used in the first embodiment except with the additional mark (') for distinguishing. No detailed description for the second embodiment is made while FIGS. 7-11 show the corresponding structures which are labeled with the similar reference numerals for comparison with those in the first embodiment. All elements in the second embodiment are essentially same as those disclosed in the first embodiment except the grounding bar 50' of the second embodiment. The grounding bar 50' extends in a vertical plane and has the corresponding protrusions 53' to form the corresponding grooves 54' alternately arranged with the protrusions 53' in the transverse direction. The spring tangs 56' extends in the same aforementioned vertical plane. A plurality of retention pegs 530' extends into the second insulator 13 to retain the grounding bar 50 thereto.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

an insulative housing including a front insulator and a rear insulator along a front-to-back direction, the front insulator forming a mating cavity forwardly to communicate with an exterior, a plurality of passageways extending along the front-to-back direction and communicating with the mating cavity in a vertical direction perpendicular to said front-to-back direction;

a plurality of contacts disposed in the corresponding passageways, respectively, each of said contacts including, along the front-to-back direction, a front contacting section extending into the mating cavity, and a rear soldering section, said contacts including grounding contacts thereof;

a metallic shielding plate integrally formed with the rear insulator and secured to the front insulator;

at least one grounding bar positioned around the rear insulator and extending along a transverse direction perpendicular to said front-to-back direction and said vertical direction;

a plurality of wires extending rearwardly behind the front insulator along the front-to-back direction, each of said wires including an inner conductor soldered to the soldering section of the corresponding contact, and an outer conductor enclosing said inner conductor; and a metallic shielding shell enclosing the housing; wherein said grounding bar mechanically and electrically connects to the metallic shell, the shielding plate, the grounding contacts and the outer conductors.

2. The electrical connector assembly as claimed in claim 1, wherein said grounding bar includes an elongated wall extending along the transverse direction, and the outer conductors of the wires are attached to the elongated wall.

3. The electrical connector assembly as claimed in claim 2, wherein the rear insulator forms a plurality of grooves to receive the solder sections of the contacts of the corresponding contacts and the inner conductors of the corresponding wires, respectively.

4. The electrical connector assembly as claimed in claim 3, wherein the grounding bar further includes a plurality of contacting fingers received within the grooves and connected to the soldering sections of the corresponding grounding contacts, respectively.

5. The electrical connector assembly as claimed in claim 4, wherein said grounding bar further includes a plurality of spring tangs contacting the shielding shell.

6. The electrical connector assembly as claimed in claim 5, wherein said grounding bar includes a pair of abutment arms abutting against the shielding plate.

7. The electrical connector assembly as claimed in claim 6, wherein said grounding bar forms a plurality of grooves in which the outer conductors of the wires are disposed.

8. The electrical connector assembly as claimed in claim 1, wherein said shielding plate includes a pair of opposite spring latches extending into the mating cavity sidewardly.

9. The electrical connector assembly as claimed in claim 8, wherein said shielding plate further include includes a pair of spring fingers extending forwardly into the mating cavity.

10. An electrical connector assembly comprising:

a metallic shielding shell;

an insulative housing enclosed within the shielding shell and forming a forwardly open mating cavity along a front-to-back direction, and a plurality of passageways each extending along the front-to-back direction and arranged with two rows in a vertical direction perpendicular to the front-to-back direction, each row of contacts spanning in a transverse direction perpendicular to both said front-to-back direction and said vertical direction, each of said passageways communicating with the mating cavity in said vertical direction;

two rows of contacts disposed in the corresponding passageways, respectively, each of the contacts including a front contacting section extending into the mating cavity, and a rear soldering section;

a metallic shielding plate attached to the housing and located between two rows of contacts in the vertical direction;

a plurality of wires extending rearwardly behind the housing, each of said wires including an inner conductor soldered to the soldering section of the corresponding contact, and an outer conductor enclosing the inner conductor; and a grounding bar extending along the transverse direction and directly contacting the metallic shielding shell, the shielding plate, the outer conductors of the wires, and the contacts which are grounded; wherein the housing includes a front insulator and a rear insulator along the front-to-back direction, and the shielding plate is integrally formed with the rear insulator via an insert-molding process; wherein the rear insulator includes a plurality of grooves to receive the corresponding soldering sections, respectively; wherein the grounding bar includes a plurality of forwardly extending contacting fingers, and some of said grooves further receive said contacting fingers which are soldered with the soldering sections of the corresponding contacts for grounding.

11. The electrical connector assembly as claimed in claim 10, wherein the shielding plate includes at least one securing tab via which the rear insulator is attached to the front insulator.

12. The electrical connector assembly as claimed in claim 10, wherein some of said grooves further receive the inner conductors of the corresponding wires which are soldered to the soldering sections of the corresponding contacts.

13. The electrical connector assembly as claimed in claim 10, wherein said grounding bar further forms a plurality of grooves receiving corresponding wires therein, respectively.

14. The electrical connector assembly as claimed in claim 13, wherein the grounding bar is secured to the rear insulator.

15. An electrical connector assembly comprising:

a metallic shielding shell;

an insulative housing enclosed within the shielding shell and forming a forwardly open mating cavity along a front-to-back direction, and at least one row of passageways arranged in a transverse direction perpendicular to the front-to-back direction, each of said passageways extending along the front-to-back direction, each of said passageways communicating with the mating cavity in a vertical direction perpendicular to both the front-to-back direction and said transverse direction;

at least one row of contacts disposed in the corresponding passageways, respectively, each of the contacts including a front contacting section extending into the mating cavity, and a rear soldering section;

a metallic shielding plate attached to the housing and extending in a horizontal plane defined by the front-to-back direction and the transverse direction;

a plurality of wires extending rearwardly behind the housing, each of said wires including an inner conductor soldered to the soldering section of the corresponding contact, and an outer conductor enclosing the inner conductor; and a grounding bar extending along the transverse direction and directly contacting the metallic shielding shell, the shielding plate, the outer conductors of the wires, and the contacts which are grounded; wherein the housing includes a front insulator on which the contacts are disposed, and a rear insulator on which the grounding bar is positioned; wherein said shielding plate includes a pair deflectable latches sidewardly extending into the mating cavity, and a pair of spring fingers forwardly extending into the mating cavity.

* * * * *